US006681524B1

(12) United States Patent
Tillson

(10) Patent No.: US 6,681,524 B1
(45) Date of Patent: Jan. 27, 2004

(54) INSULATED, WEATHERPROOF, AND LOCKABLE PET DOOR

(76) Inventor: Richard Arthur Tillson, 110 Choctaw Cir., Chanhassen, MN (US) 55317

( * ) Notice: Subject to any disclaimer, the term of this patent is extended or adjusted under 35 U.S.C. 154(b) by 0 days.

(21) Appl. No.: 10/231,810

(22) Filed: Aug. 29, 2002

(51) Int. Cl.[7] ..... E05D 15/48; E05F 11/52; E06B 7/28

(52) U.S. Cl. ..... 49/169; 49/163; 160/180

(58) Field of Search ..... 49/169, 163; 160/180, 160/2, 90; D25/48

(56) References Cited

U.S. PATENT DOCUMENTS

| | | | | | |
|---|---|---|---|---|---|
| 2,758,646 | A | | 8/1956 | Johnson | |
| 2,839,791 | A | | 6/1958 | Lee | |
| 3,138,829 | A | | 6/1964 | Grose | |
| 3,690,299 | A | | 9/1972 | Johnson | |
| 3,978,616 | A | | 9/1976 | Pennock | |
| 4,134,232 | A | | 1/1979 | Dodge | |
| 4,480,407 | A | | 11/1984 | Needham | |
| 4,776,133 | A | | 10/1988 | Green | |
| 4,833,828 | A | | 5/1989 | Gingrande | |
| 4,840,217 | A | | 6/1989 | Evans | |
| 4,991,350 | A | * | 2/1991 | Kirk | 49/169 |
| 5,269,097 | A | * | 12/1993 | Davlantes | 49/169 |
| D353,207 | S | * | 12/1994 | Davlantes | D25/48 |
| 5,406,748 | A | * | 4/1995 | Davlantes | 49/169 |
| 5,581,940 | A | | 12/1996 | Peterson | |
| 5,735,079 | A | | 4/1998 | Davlantes | |
| 5,946,856 | A | | 9/1999 | Davlantes | |
| D445,915 | S | * | 7/2001 | Kirk | D25/48 |

* cited by examiner

*Primary Examiner*—Alvin Chin-Shue
*Assistant Examiner*—Hugh B. Thompson

(57) ABSTRACT

A pet door has interior (22) and exterior frames (28) that assemble to define a tunnel through which a pet may pass. Attaching to the frames are rigid inner (34) and outer doors (36) that are each held closed at a non-vertical angle by force of their own weights. The outer door (36) and interior frame (22) are heavily insulated to reduce heat transfer through the pet door, and the pet door is windproof and extremely weather resistant. A locking bar (48) provides a secure method of locking the doors shut to prevent unwanted entry by animal or human.

16 Claims, 15 Drawing Sheets

INSULATED, WEATHERPROOF, AND LOCKABLE PET DOOR

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of the Invention

This invention relates generally to pet doors, and more particularly to provide draft protection and insulation for minimizing heat transfer through the pet door, provision of means for locking the pet door, and improved ease of installation.

2. Background of the Invention

Prior art pet doors provide means for unassisted entrance to and/or exit from an enclosed location (such as a house, apartment, kennel, or pen) by a domesticated animal. Inventors have created several types of pet doors but none provide significant resistance to heat transfer, and most do not provide efficient weatherproofing. Use of these existing types of pet doors in non-temperate climates (either cold or hot climates) results in drafts and high amounts of heating or cooling energy loss. Additionally, security of the home can be compromised by installation of some of the existing pet doors, because the larger doors could be used by unauthorized humans to access the interior of the dwelling. Some prior art includes disclosures to provide locking mechanisms, but these are either inadequately strong to prevent a determined human from entering, or are needlessly complex and therefore expensive to produce. Finally, some existing pet doors and prior patent art doors are difficult to install by the homeowner, since they require cutting of an appropriate hole and usually drilling of several holes through the door or wall, through which difficult blind insertion of fasteners must be accomplished.

U.S. Pat. No. 2,758,646 to Johnson (1956) discloses a basic type of pet door comprised of two flexible flaps mounted on their upper edges to a frame. One flap is larger and has a hole covered by the other flap, so the animal can push open both flaps going one way, but steps through the hole and pushes open only the smaller flap going through in the other direction. One embodiment shows an arrangement of two double flaps to improve the draft and weather resistance of the design. This design is inefficient at providing an insulated barrier for heat transfer, since at best it would provide an air space subject to convection air currents and attendant heat transfer. In practice, the flexible materials utilized in current commercial designs of this type tend to warp in hot conditions and become too stiff to properly close in cold conditions, leading to air flow, ice formation, and high heating or cooling losses through the door. An improvement to this door, U.S. Pat. No. 3,690,299 to Johnson (1972), did not address either of these problems. This patent also discloses a solid thin panel that may be inserted to prevent entry by the animal, but this is not sufficient for preventing entry by humans.

U.S. Pat. No. 2,839,791 to Lee (1958) shows a spring mounted single door that can be pushed open in either direction. This design will tend to stay ajar rather than completely close after the animal pushes through, allowing air flow through the door. This design is also not amenable to a significant amount of insulation.

U.S. Pat. No. 3,138,829 to Grose (1964) discloses a two way rigid dog door that hinges on a vertical side. The spring-loaded hinges tend to return the doors to the closed position, but the door provides no significant insulation. A further problem with the horizontally hinged door arises when an animal goes only partway through the door, then changes its mind and tries to back up. When this happens, the door will tend to close on and trap the animal, causing it distress and possibly injury.

U.S. Pat. No. 3,978,616 to Pennock (1976) shows a rigid two-way door hinged on the upper edge, with spring-loaded cams operating on the upper door surface for holding the door in a vertical, closed position. This design does not address the need for weatherproofing the edges or insulation of the door itself.

U.S. Pat. No. 4,134,232 to Dodge et al. (1979) discloses another horizontally hinged door, with tension springs providing the force to keep the door closed. This spring-closure design would have a greater tendency to close on animals if they attempt to back up rather than go all the way through, causing the problems discussed above. The door also is not designed to provide any significant amount of insulation to prevent heat transfer.

U.S. Pat. No. 4,480,407 to Needham et al. (1984) discloses a method for magnetically closing flexible or rigid flap type doors. While this can provide an improvement in terms of weather tightness of the doors, it does not address the low insulating problems, and also adds expense to production of a door, since the design requires mating magnetic members. Also, the deformation of flexible doors in extreme heat or cold can overcome the ability of magnets to seal the gap.

U.S. Pat. No. 4,776,133 to Green (1988) discloses a locking mechanism to prevent door opening in one or both directions, but the mechanism is not strong enough to prevent forced entry by a determined human being.

U.S. Pat. No. 4,833,828 to Gingrande (1989) discloses a spring-return pet door design that is hinged horizontally in the middle of the door. While this possibly addresses some of the weather proofing and draft prevention issues, the mechanism requires the animal to enter and exit on opposite sides of the hinge, which would increase the difficulty of training the animal to use the door. More importantly, the required surface area of the invention is twice that for a double-acting single door, which increases the area of heat transfer. This design makes no claims of insulation possibilities. U.S. Pat. No. 5,581,940 to Peterson (1996) poses similar problems.

U.S. Pat. No. 4,840,217 to Evans (1989) discloses a design that is comprised of two separate doors, each of which opens only in one direction. This requires training an animal to pry open one door and push through the other. This training would be beyond most pet owner's capabilities, not to mention most pet's abilities.

U.S. Pat. No. 5,735,079 to Davlantes (1998) and U.S. Pat. No. 5,946,856 to Davlantes (1999) describe embodiments of the sliding panel type security door that is held along its edges by channels. This arrangement is not strong enough to prevent forced entry by a human being.

The prior art does not provide a pet door design that includes significant insulating characteristics, weather tightness, positive door closure, means of securely locking the door, and ease of use by the animal, and ease of installation for the owner in one configuration.

BACKGROUND OF INVENTION—OBJECTS AND ADVANTAGES

Accordingly, several objects and advantages of the present patent application are:

- to provide a bi-directional door that is easily operated by a domestic animal to exit or enter an enclosed space;
- to provide a door designed to tightly and positively close when not in use to prevent air flow and drafts, to be resistant to opening by wind, and to be weatherproof to rain, sleet, or snow;
- to provide a door that incorporates significant thickness of insulating material so the door is an effective impediment to heat transfer without increasing the difficulty of operation by the animal;
- to provide a simple but robust means of locking the pet door to prevent unauthorized entry by humans or other animals;
- to provide a design which makes installation of a pet door easier for the installer;
- to provide a door design that is adjustable for installation in a variety of exterior doors or thicker wall sections without modification; and
- to provide a design that can be manufactured for relatively low cost.

Further objects and advantages of my invention will become apparent from a consideration of the drawings and ensuing description.

SUMMARY

In accordance with the present invention a pet door is comprised of an interior and exterior frame suitable for mounting in a hole cut in an exterior door or wall; a spacer providing an extended tunnel for thicker wall sections; an insulating core for the interior frame; an interior door that opens in only one direction; an insulated outer door that opens in both directions but closes against the inner door; and a locking bar mechanism that secures both doors in the closed position. Both the inner and outer doors are shut at opposing non-vertical angles, which allows the weight of each door to provide a constant closing torque operating to maintain closure until counteracted by force provided by the entering or exiting domestic animal.

DRAWINGS

DRAWINGS-LIST OF REFERENCE NUMERALS

Figure 1:
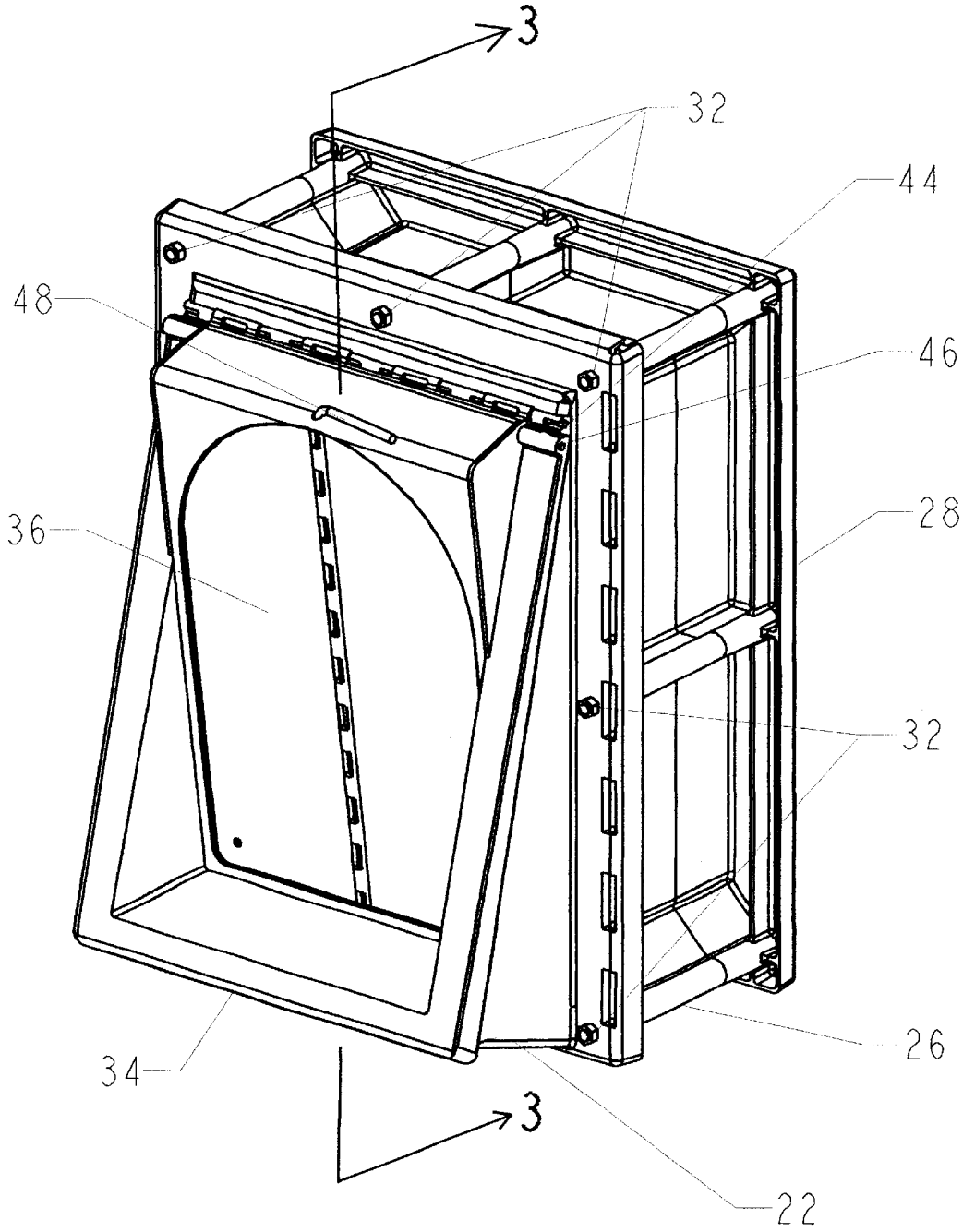
FIG. 1 shows a perspective view of the completely assembled group of all components in this invention, as seen from the interior side.

| | |
|---|---|
| 20 | Structural wall with cutout |
| 22 | Interior frame |
| 24 | Interior frame core |
| 26 | Wall spacer |
| 28 | Exterior frame |
| 30 | Bolt |
| 32 | Nut |
| 34 | Inner door |
| 36 | Outer door assembly |
| 38 | Outer door interior shell |
| 40 | Outer door core |
| 42 | Outer door exterior shell |
| 44 | Inner door hinge pin |
| 46 | Outer door hinge pin |
| 48 | Locking bar |
| 50 | Frame base |
| 52 | Door stop outer face |
| 54 | Locking hole |
| 56 | Inner face of door stop |
| 58 | Flange |
| 60 | Hinge knuckle |
| 62 | Boss |
| 64 | Bolt hole |
| 66 | Opening |
| 67 | Floor support |
| 68 | Channel |
| 69 | Weatherstrip notch |
| 70 | Rib |
| 73 | Flat face |
| 74 | Boss hole |
| 75 | Opening |
| 76 | Locking hole |
| 77 | Groove |
| 78 | Lip |
| 80 | Hinge knuckle |
| 82 | Hinge knuckle |
| 84 | Stop flange |
| 86 | Side wall |
| 87 | Inside wall |
| 88 | Flange |
| 89 | Top wall |
| 90 | Locking hole |
| 91 | Locking hole |
| 92 | Opening |
| 94 | Screw hole |
| 96 | Locking bar channel |
| 98 | Boss hole |
| 100 | Hinge knuckle |
| 102 | Boss |
| 104 | Boss |
| 105 | Screw |
| 108 | Flange |
| 108 | Boss |
| 110 | Rib |

-continued

| DRAWINGS-LIST OF REFERENCE NUMERALS |
|---|
| 112 Frame base |
| 114 Boss |
| 116 Rib |
| 118 Flange |
| 120 Opening |
| 122 Hexagonal cavity |

DETAILED DESCRIPTION—FIGS. 1–15—PREFERRED EMBODIMENT

A preferred embodiment of the present invention is illustrated in FIGS. 1 through 15.

FIG. 1 shows a perspective view of the completely assembled group of all components in this invention, showing the interior side, with doors closed and locked. An interior frame 22 is attached to a wall spacer 26 and an exterior frame 28 by means of bolts 30 (not shown in FIG. 1) and nuts 32. The two frame from a clamp to enclose a precut hole in a door or structural wall in a dwelling. The interior frame 22 is pivotally attached to an inner door 34 by means of an inner door hinge pin 44 that connects alternating integrated hinge knuckles on the interior frame 22 and inner door 34. An outer door assembly 36 is pivotally attached to the inner door 34 by an outer door hinge pin 46 that connects alternating integrated hinge knuckles on the inner door 34 and outer door assembly 36. A locking bar 48 is shown in position to prevent opening of the doors, passing through openings in the inner door 34, the outer door assembly 36, and the interior frame 22. The locking bar 48 can be stored in a channel 68 (FIG. 4) in the interior frame 22 when not used for locking the doors shut.

Figure 2:
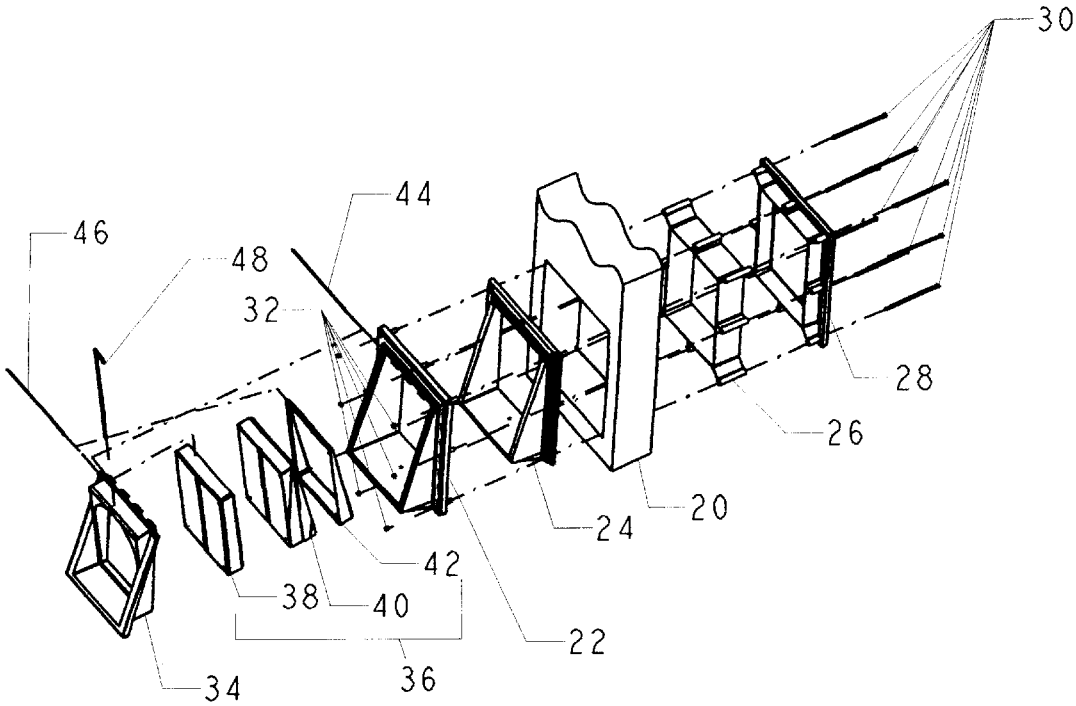
FIG. 2 shows an exploded view of the invention components along with a representation of a portion of structural wall or door cutout to which the invention would be attached.

FIG. 2 shows an exploded view of the invention components along with a representation of a portion of structural wall or door cutout 20 to which the invention would be attached. In addition to the components identified for FIG. 1, an interior frame core 24 is shown that nests inside the exterior-side cavity of the interior frame 22. Bolts 30 are shown on the explode lines to insert through the exterior frame 28, the wall spacer 26, the interior frame core 24, the interior frame 22, and fasten with corresponding nuts 32. The inner door hinge pin 44 is shown lined up with the hinge knuckles 60 (see FIG. 4) on the interior frame, and a dotted line from the inner door hinge pin 44 also lines up with the hinge knuckles 80 (see FIG. 8) on the inner door 34. The outer door hinge pin 46 is shown lined up with the hinge knuckles 82 (see FIG. 8) on the inner door 34, and a dotted line from the outer door hinge pin 46 also lines up with a hinge knuckle 100 (see FIG. 10) on an outer door exterior shell 42. The outer door assembly 36 is shown exploded to its three major components, an outer door interior shell 38, an outer door core 40, and the outer door exterior shell 42.

Figure 3:
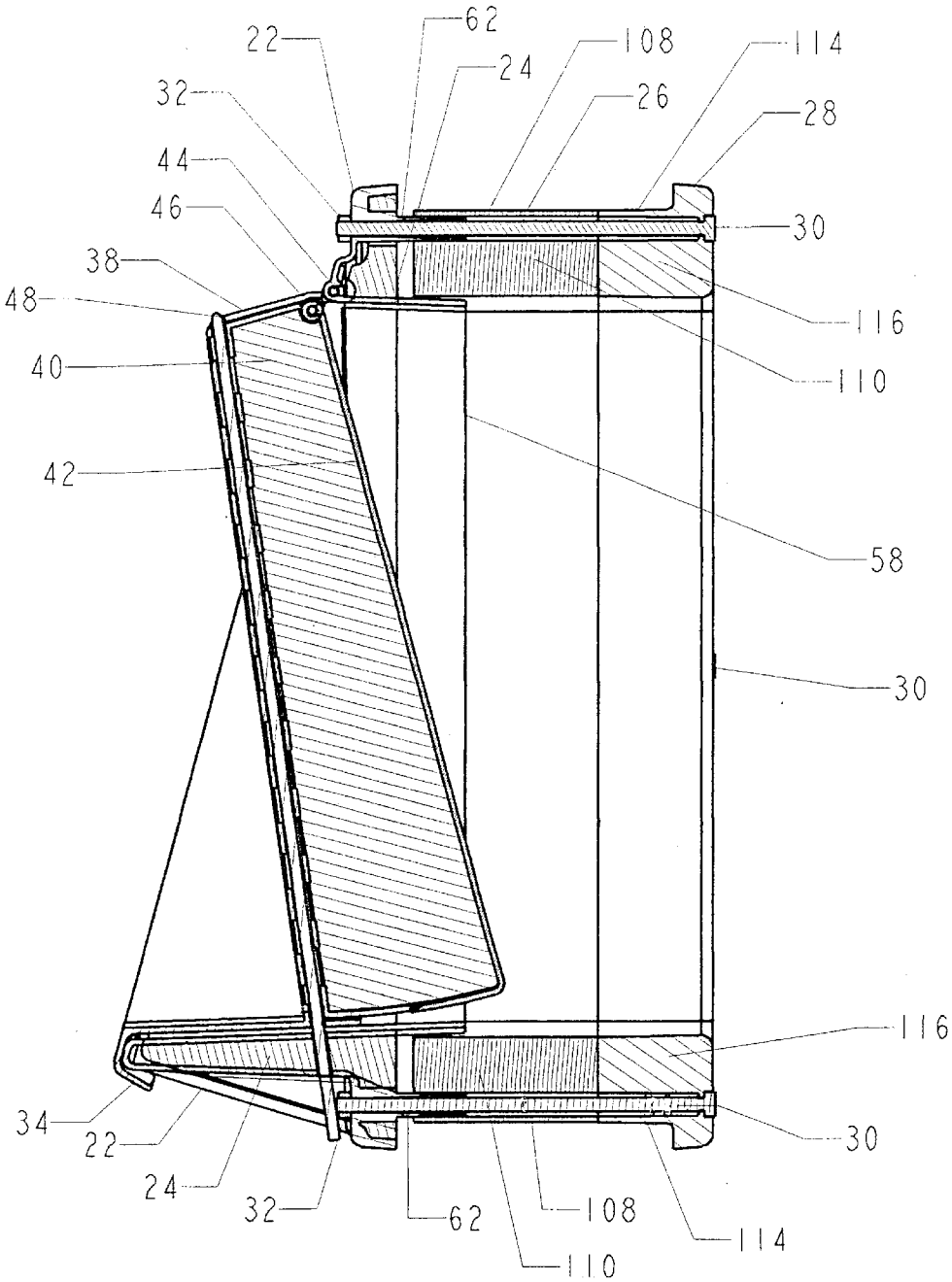
FIG. 3 shows a cross-section view of the invention indicated by the section lines 3—3 in FIG. 1.

FIG. 3 shows a cross-section view of the invention indicated by the section lines 3—3 in FIG. 1, and provides a clearer picture of the juxtaposition and orientation of the assembled components. Ribs 116 and bosses 114 on the exterior frame 28 are contiguous with a flange 118 (see FIG. 12). These structures are designed to mate flush with corresponding ribs 110, bosses 108, and flange 106 on the wall spacer 26 when bolted together. The wall spacer 26 is used only for installation in thicker wall sections, and can be eliminated when the invention is to be installed in a cutout in a residential door. Bosses 62 and a flange 58 on the interior frame 22 are designed to fit inside the openings of the corresponding bosses 108 or 114, and inside the perimeter of flanges 106 or 118. This provides adjustability for the thickness of door or wall section to be accommodated by the invention. The inner door 34 is hinged to the interior frame 22 by the inner door hinge pin 44, and is prevented from pivoting to a vertical position by the structure of the interior frame 22. The shape of the inner door 34 is designed to maintain its center of gravity to the left of the vertical plane containing the inner door pivot point, providing a torque acting to close the door when no counteracting force (provided by the domestic animal) is present. The outer door assembly 36 is hinged to the inner door 34 by the outer door hinge pin 46, and is prevented from pivoting to a vertical position by a lip 78 and inside walls 87 on the inner door 34. The shape of the outer door assembly 36 is designed to maintain its center of gravity to the right of the vertical plane containing the outer door pivot point, providing a torque acting to close the door when no counteracting force (provided by the domestic animal) is present. The weight of the outer door assembly 36 is applied at its pivot point to the left of the inner door pivot point, which provides additional closing torque to the inner door. The bottom portion of the outer door assembly (36) is shaped with enough clearance to allow the outer door to rotate freely and bidirectionally through the openings provided by the interior frame 22, wall spacer 26, and exterior frame 28. The locking bar 48 is shown in position so as to prevent opening of either door since it passes through the inner door 34 top and bottom, the outer door interior shell 38, the interior frame 22, and the interior frame core 24.

Figure 4:
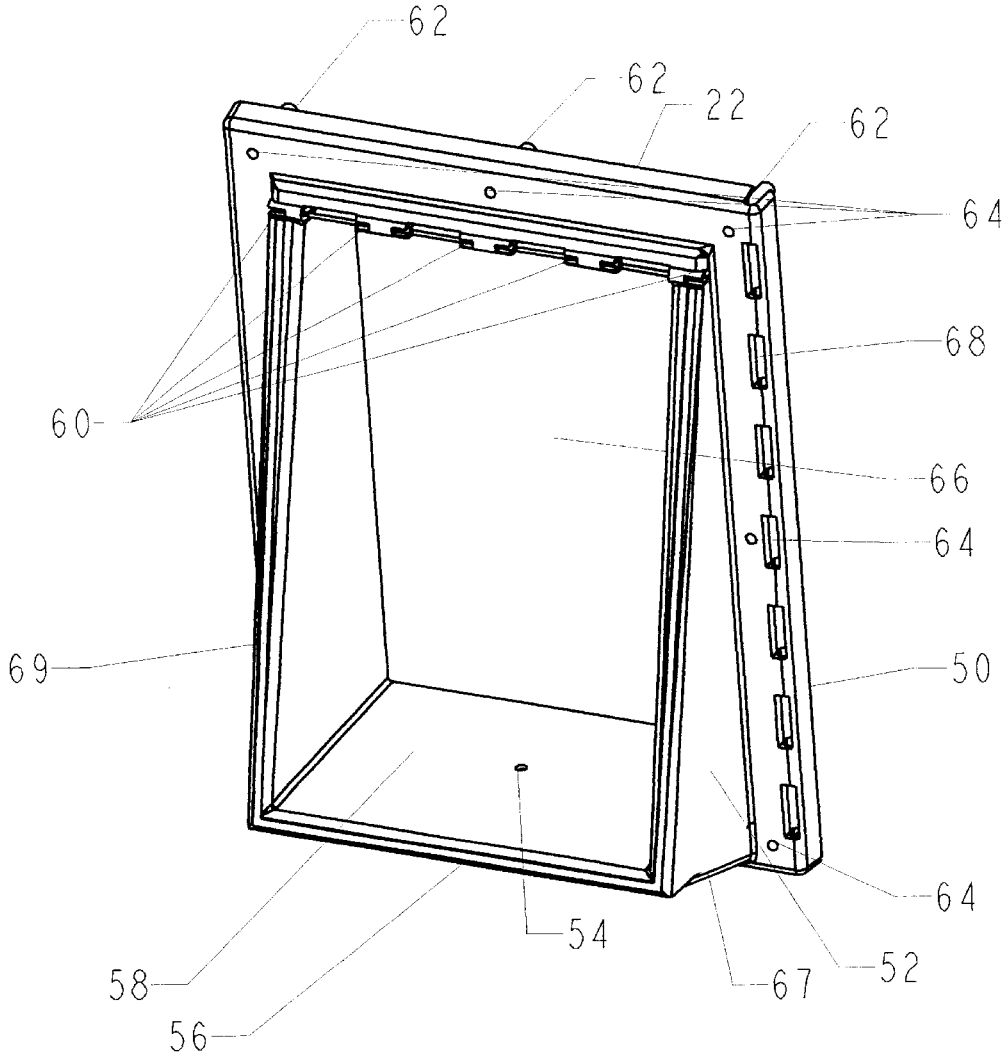
FIG. 4 shows a perspective view of the interior side of the interior frame.

FIG. 4 shows a perspective view of the interior side of the interior frame 22. In the preferred embodiment features shown are formed from contiguous plastic material by a manufacturing method such as injection molding or vacuum/pressure thermoforming. A series of hollow bosses 62 around the frame base 50 provide cylindrical guides for insertion of the bolts 30 through the bolt holes 64. The channel 68 provides storage for the locking bar 48 when the bar is not serving to lock the assembly closed. A door stop outer face 52, door stop inner face 56, and flange 58 connect to the frame base 50, form the angled stop for the inner door 34 and provide the interior portion of the tunnel for the animal to pass through. A locking hole 54 passes through the floor of the flange 58. A part of a floor support 67 can be seen in this figure, and again in FIG. 5. These floor supports provide additional cantilever support to the flange 58 subject to the animal's weight. The exterior of the flange 58 has an opening 66 through which the outer door assembly 36 can pivot and the animal's body passes. The Inner face of door stop 56 contains a continuous weatherstrip notch 69 on three sides. An adhesive-backed weatherstripping material (not shown) can be added in this notch if desired. A series of formed hinge knuckles 60 along the top side of the interior opening fit together with alternating hinge knuckles on the inner door 34.

Figure 5:
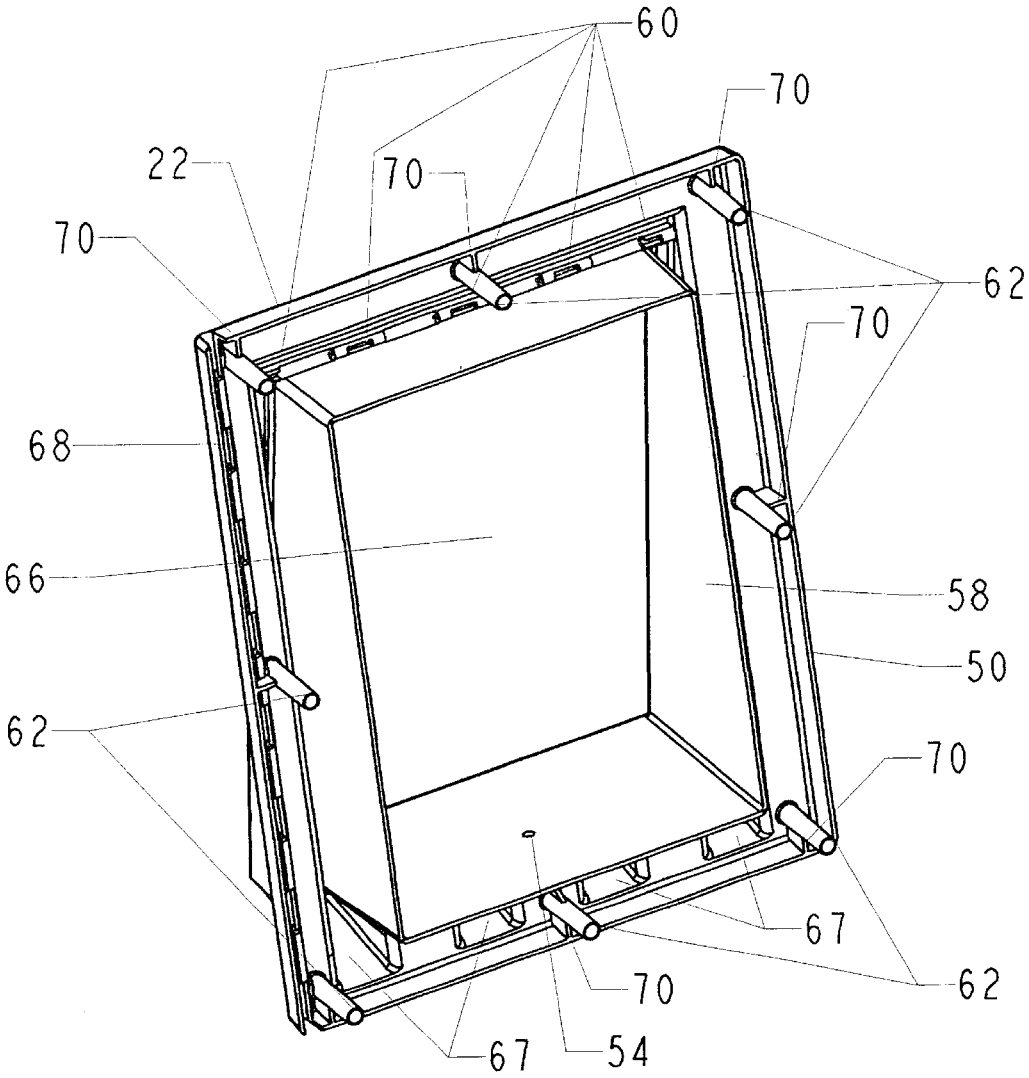
FIG. 5 shows a perspective view of the exterior side of the interior frame.

FIG. 5 shows a perspective view of the exterior side of the interior frame 22. This shows many of the features discussed for FIG. 4. The exterior side drawing shows the interior frame 22 to be a hollow shell with thin walls forming a cavity. The bosses 62 and flange 58 are tapered slightly inwards and extended beyond the vertical plane formed by the exterior side of the frame base 50 to allow telescopic insertion into the larger bosses and flanges in the wall spacer 26 or the exterior frame 28, as shown in FIG. 3. A series of ribs 70 support the bosses 62 by connection with the frame base 50.

Figure 6:
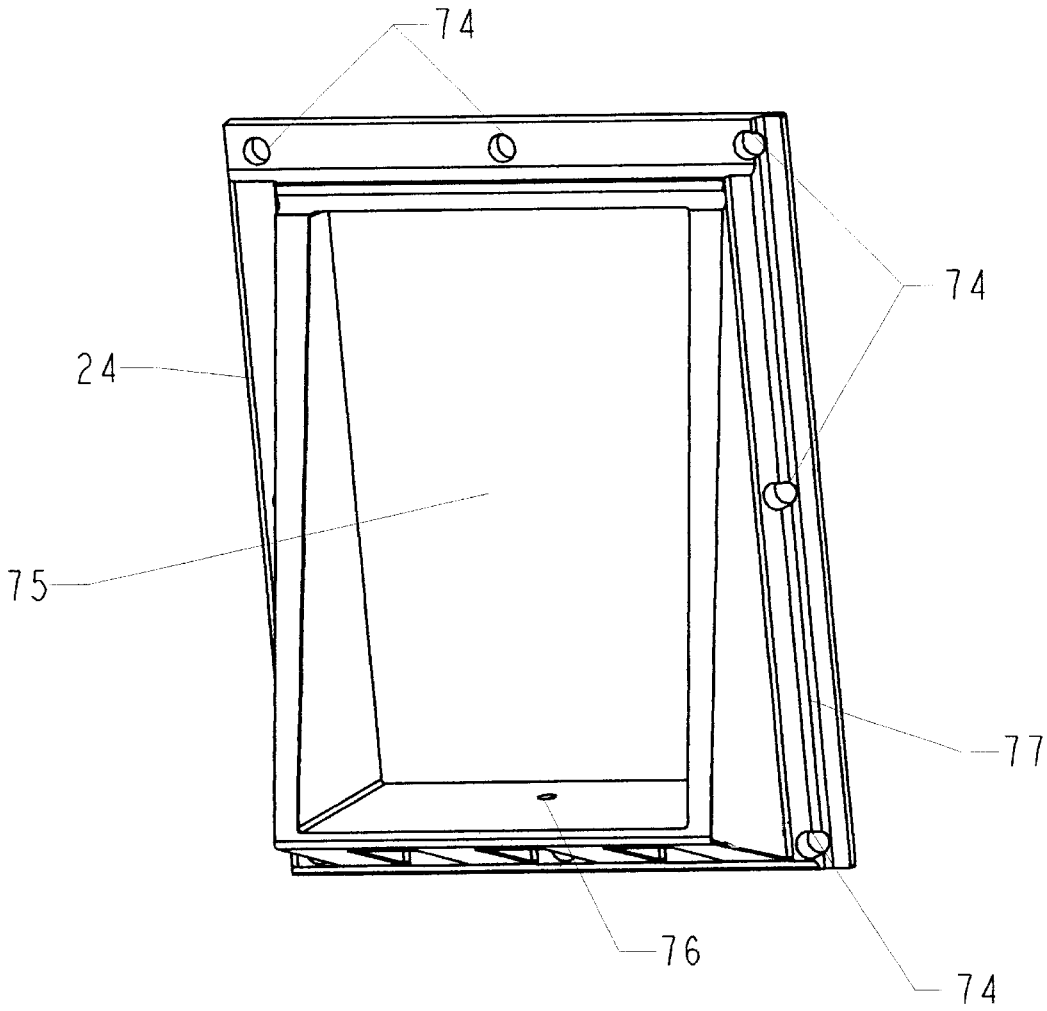
FIG. 6 shows a perspective view of the interior side of the interior frame code.

FIG. 6 shows a perspective view of the interior side of the interior frame core 24. In the preferred embodiment features shown are formed from contiguous insulating material such as polystyrene or urethane foam by a manufacturing method such as injection molding or casting. The interior frame core 24 is shaped to fill the cavity of the interior frame 22. A series of boss holes 77 allow passage through for bosses on the interior frame 22, wall spacer 26, and/or exterior frame 28. Other features are a groove 77 to provide clearance for channel 68 in the interior frame 22, and a locking hole 76 to permit passage of the locking bar 48. An opening 75 allows for the pivoting of the outer door assembly 36.

Figure 7:
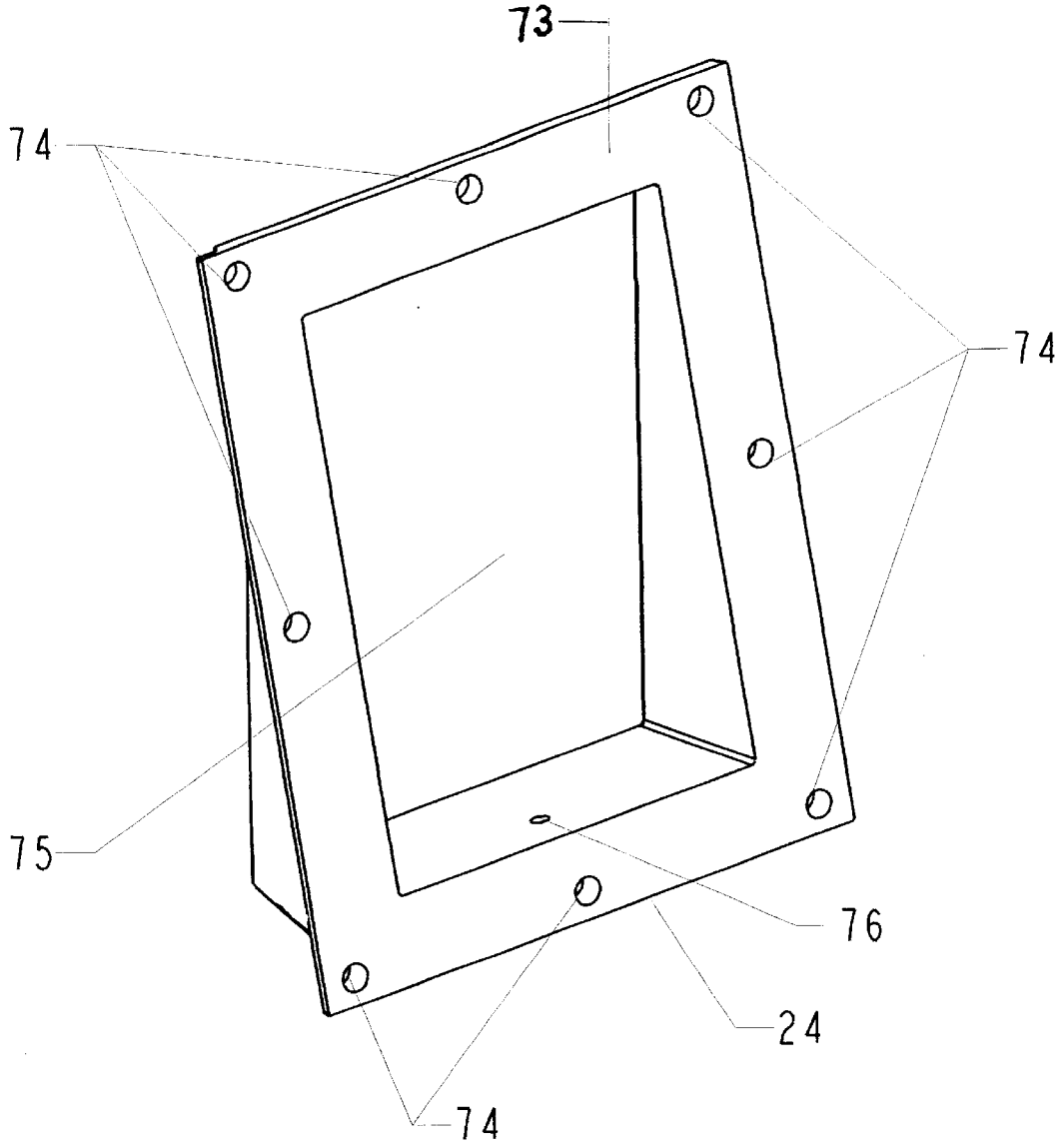
FIG. 7 shows a perspective view of the exterior side of the interior frame code.

FIG. 7 shows a perspective view of the exterior side of the interior frame core 24. Some features discussed for FIG. 6 are shown again. The exterior side of the interior frame core 24 is a flat face 73, which will seal and insulate the interior surface surrounding the cutout of the residential door or wall when the invention is assembled.

Figure 8:
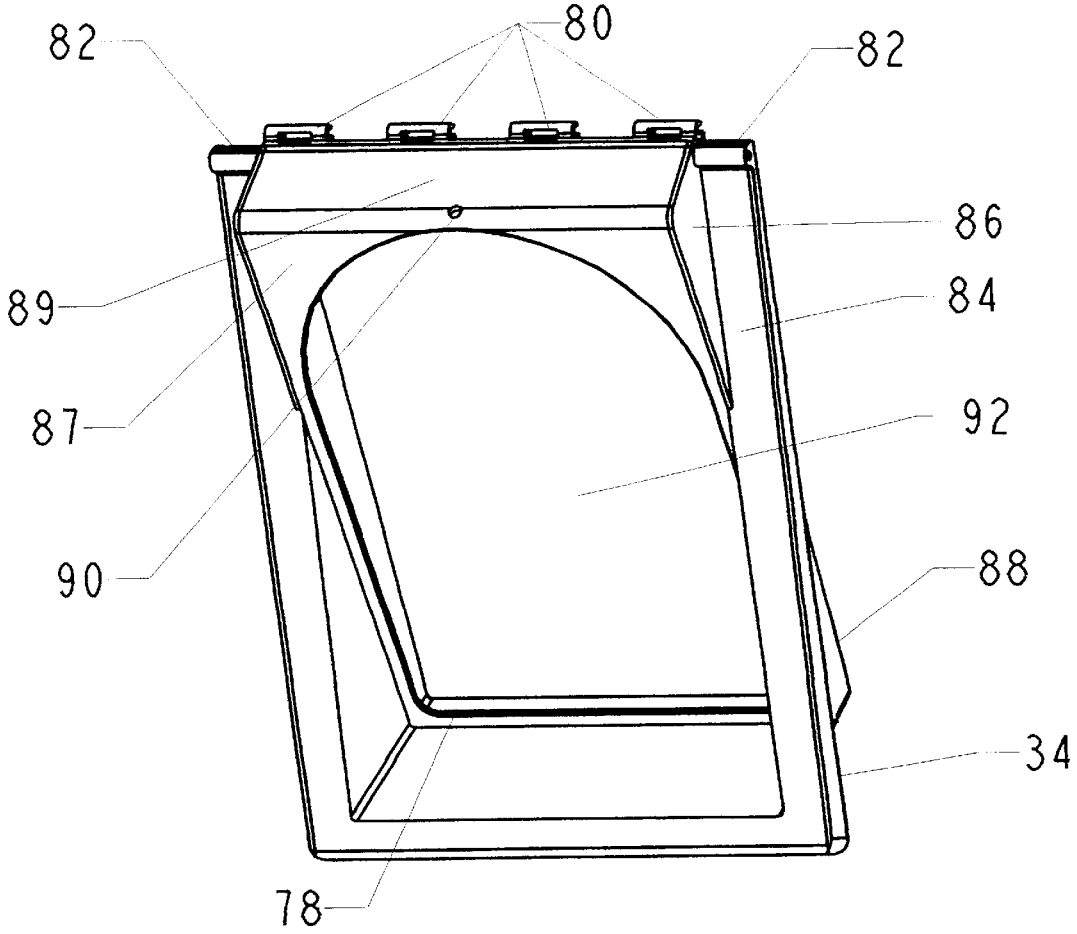
FIG. 8 shows a perspective view of the interior side of the inner door.

FIG. 8 shows a perspective view of the interior side of the inner door 34. In the preferred embodiment features shown are formed from contiguous plastic material by a manufacturing method such as injection molding or vacuum/pressure thermoforming. The hinge knuckles 80 assemble to the hinge knuckles 60 on the interior frame 22, held together by the inner door hinge pin 44. The hinge knuckles 82 assemble to the hinge knuckle 100 on the outer door exterior shell 42, held together by the outer door hinge pin 46. A flange 88 provides sides and a floor for the door, and is designed to clear the structure of the interior frame 22 throughout the inwardly pivoting motion. A stop flange 84 contacts the inner face of door stop 56 on the interior frame 22, allowing opening of the door only inwards away from the exterior, and maintaining the non-vertical angle of closure. The side walls 86, top wall 89, inside wall 87, and lip 78 provide the stop for the outer door assembly 36, and are designed to provide the closure angle for the outer door assembly 36 which allows the weight of the outer door to provide closure torque on its hinge. The top locking hole 90 provides clearance for insertion of the locking bar 48. An opening 92 allows for exit of the animal.

Figure 9:
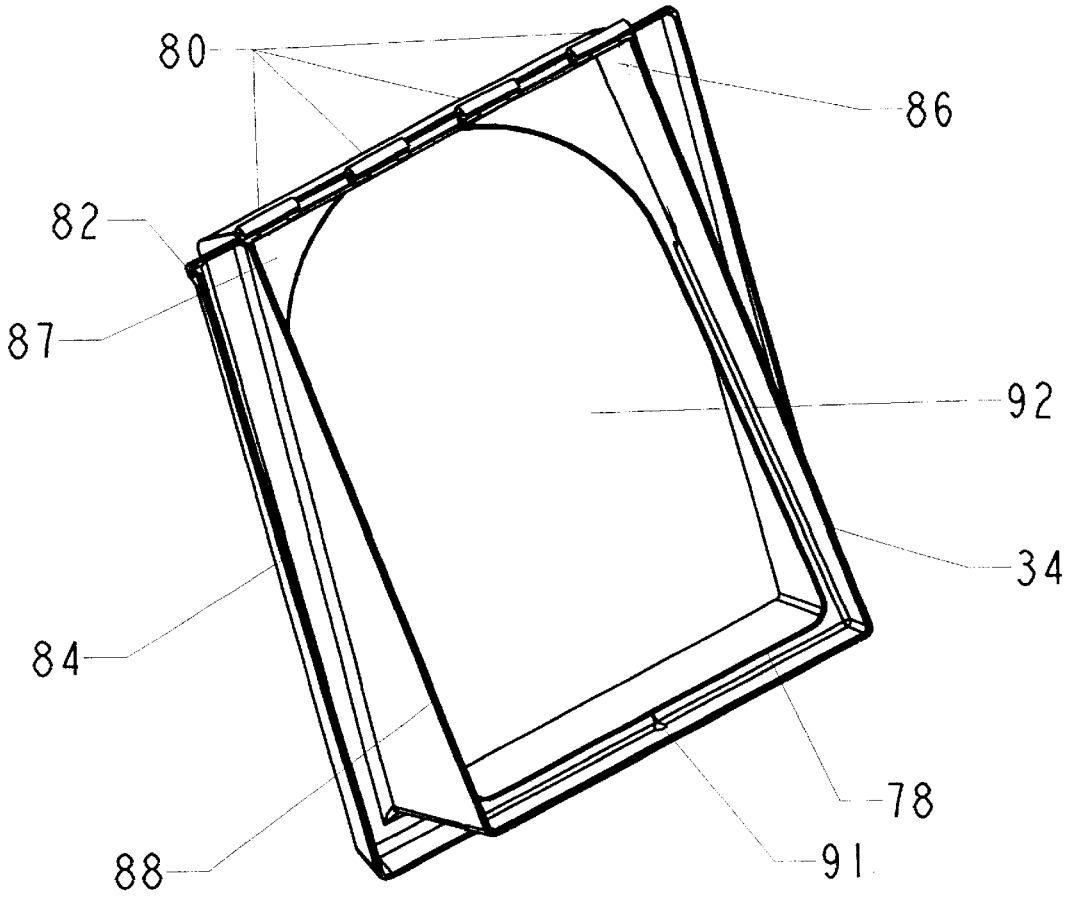
FIG. 9 shows a perspective view of the exterior side of the inner door.

FIG. 9 shows a perspective view of the exterior side of the inner door 34. In addition to the features discussed for FIG. 8, a locking hole 91 provides for insertion of the locking bar 48.

Figure 10:
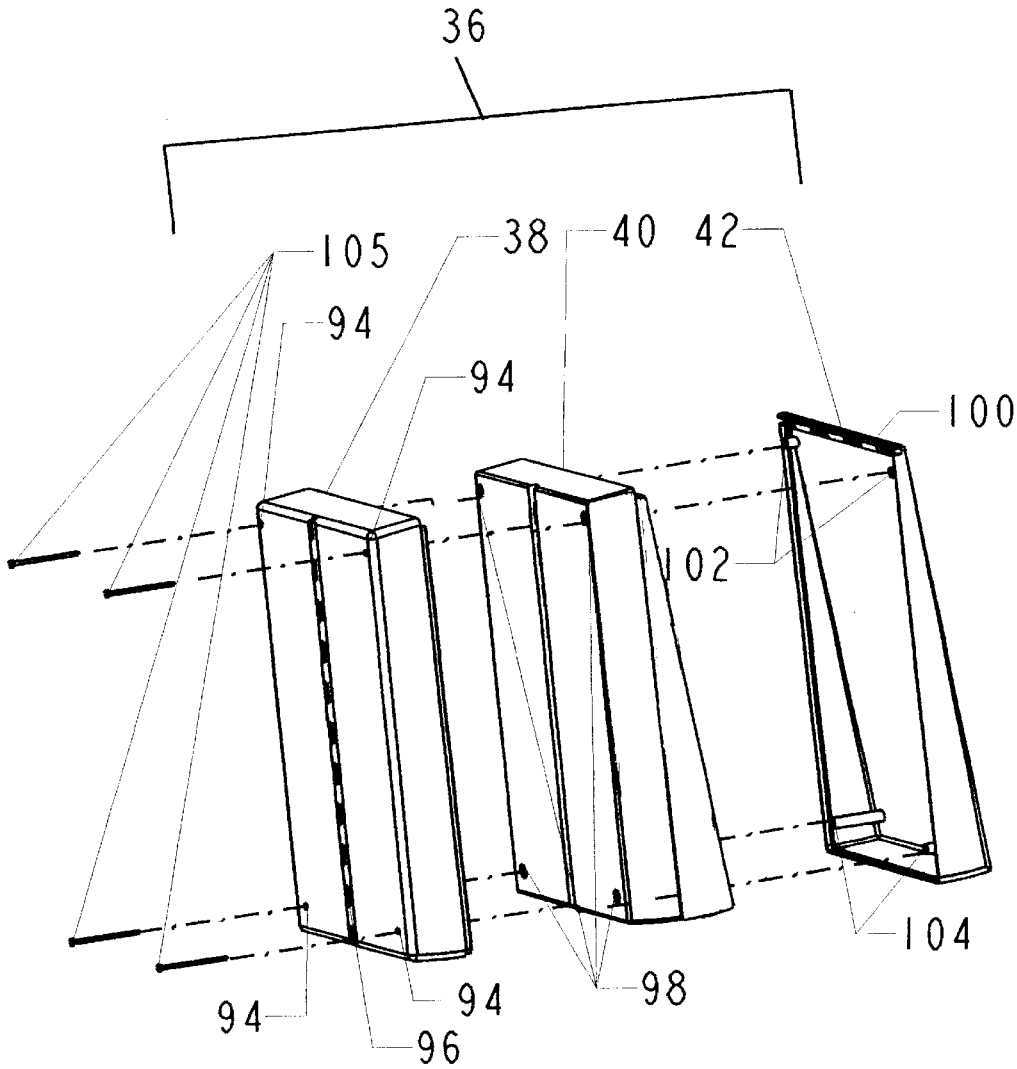
FIG. 10 shows an exploded view of the components of the outer door assembly.

FIG. 10 shows an exploded view of the components of the outer door assembly 36. In the preferred embodiment features shown on the outer door interior shell 38 and the outer door exterior shell 42 are formed from contiguous plastic material by a manufacturing method such as injection molding or vacuum/pressure thermoforming. Features shown on the outer door core 40 are formed from contiguous insulating material such as polystyrene or urethane foam by a manufacturing method such as injection molding or casting. The outer door core 40 is designed to fit snugly within the cavity formed by the outer door interior shell 38 and the outer door exterior shell 42. Screws 105 are fastened through screw holes 94 and boss holes 98 to bosses 102 and 104 on the outside door exterior shell, holding the outer door assembly together. The hinge knuckle 100 assembles to the hinge knuckles 82 on the inner door 42, held together by the outer door hinge pin 46. The locking bar channel 96 in the interior face of the outer door interior shell provides a tube through which the locking bar 48 is slid to fasten the doors closed when desired.

Figure 11:
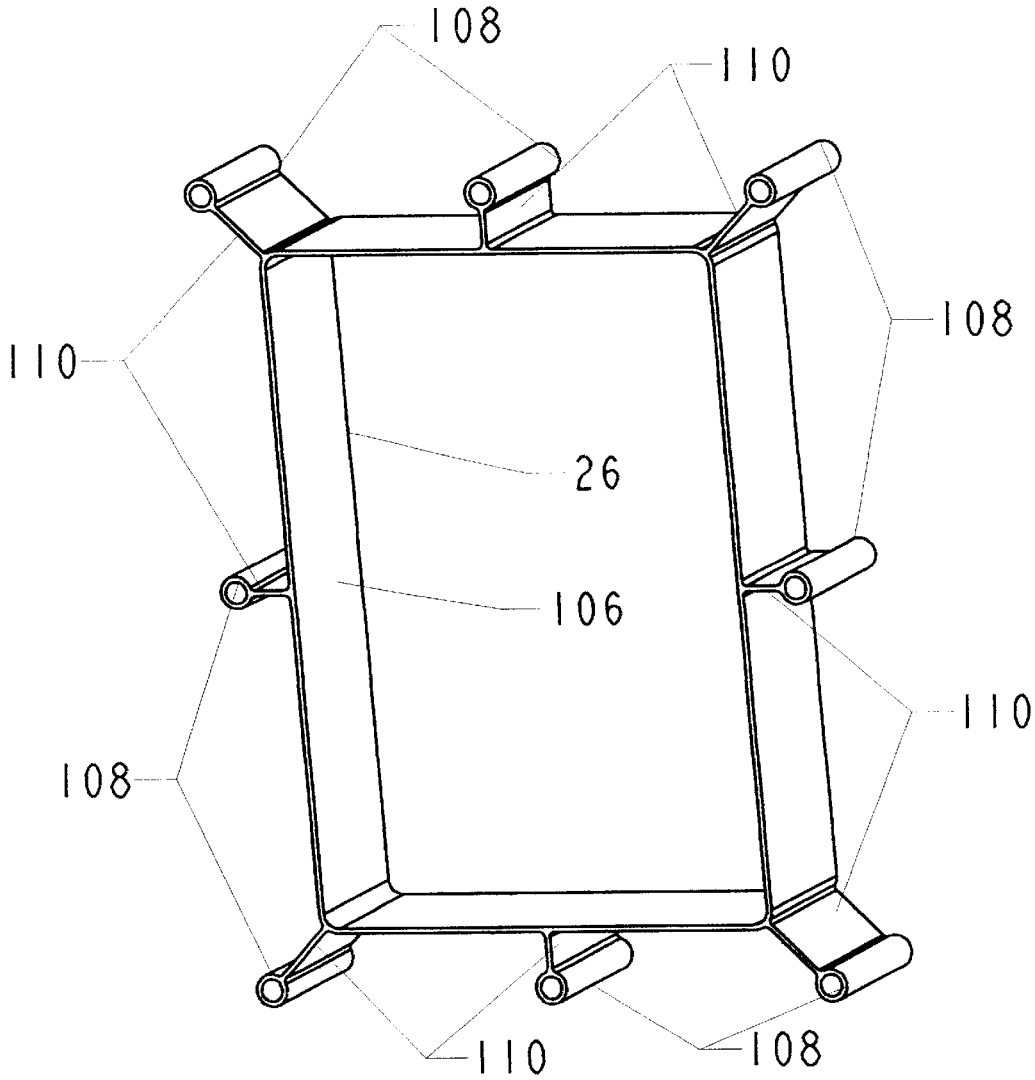
FIG. 11 shows a perspective view of the wall spacer.

FIG. 11 shows a perspective view of the wall spacer 26. In the preferred embodiment features shown are formed from contiguous plastic material by a manufacturing method such as injection molding or vacuum/pressure thermoforming. The flange 106 is connected to ribs 110, which in turn are connected to cylindrical hollow bosses 108, which provide guides and supports for the bolting together of the invention around the hole in the residence door or wall.

Figure 12:
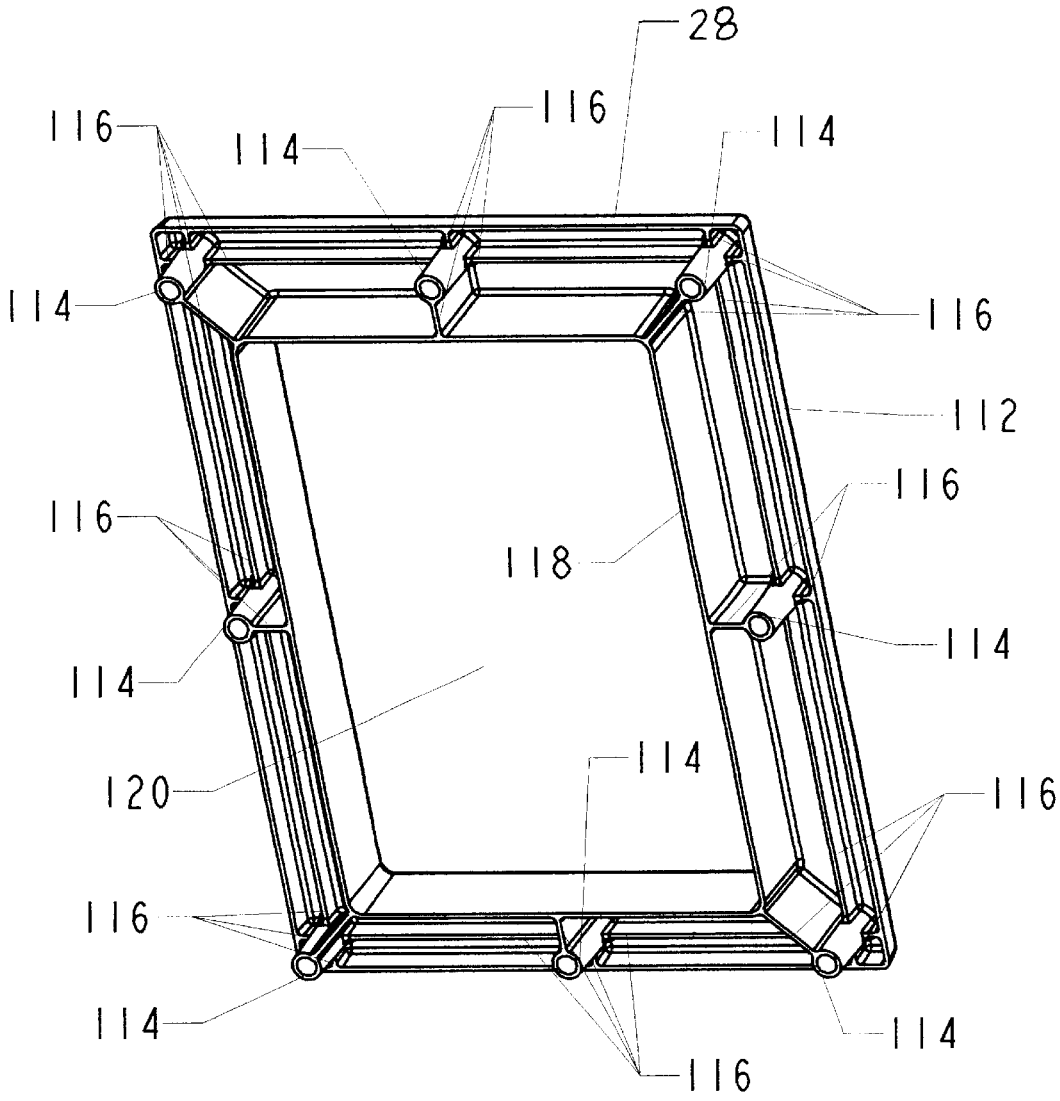
FIG. 12 shows a perspective view of the interior side of the exterior frame.

FIG. 12 shows a perspective view of the interior side of the exterior frame 28. In the preferred embodiment features shown are formed from contiguous plastic material by a manufacturing method such as injection molding or vacuum/pressure thermoforming. This is comprised of a frame base 112 which connects to the flange 118, various ribs 116, and cylindrical hollow bosses 114 to accommodate bolting of the assembly to the residence wall or door. The opening 120 allows pivoting of the outer door assembly 36, and passage of the animal to and from the residence.

Figure 13:
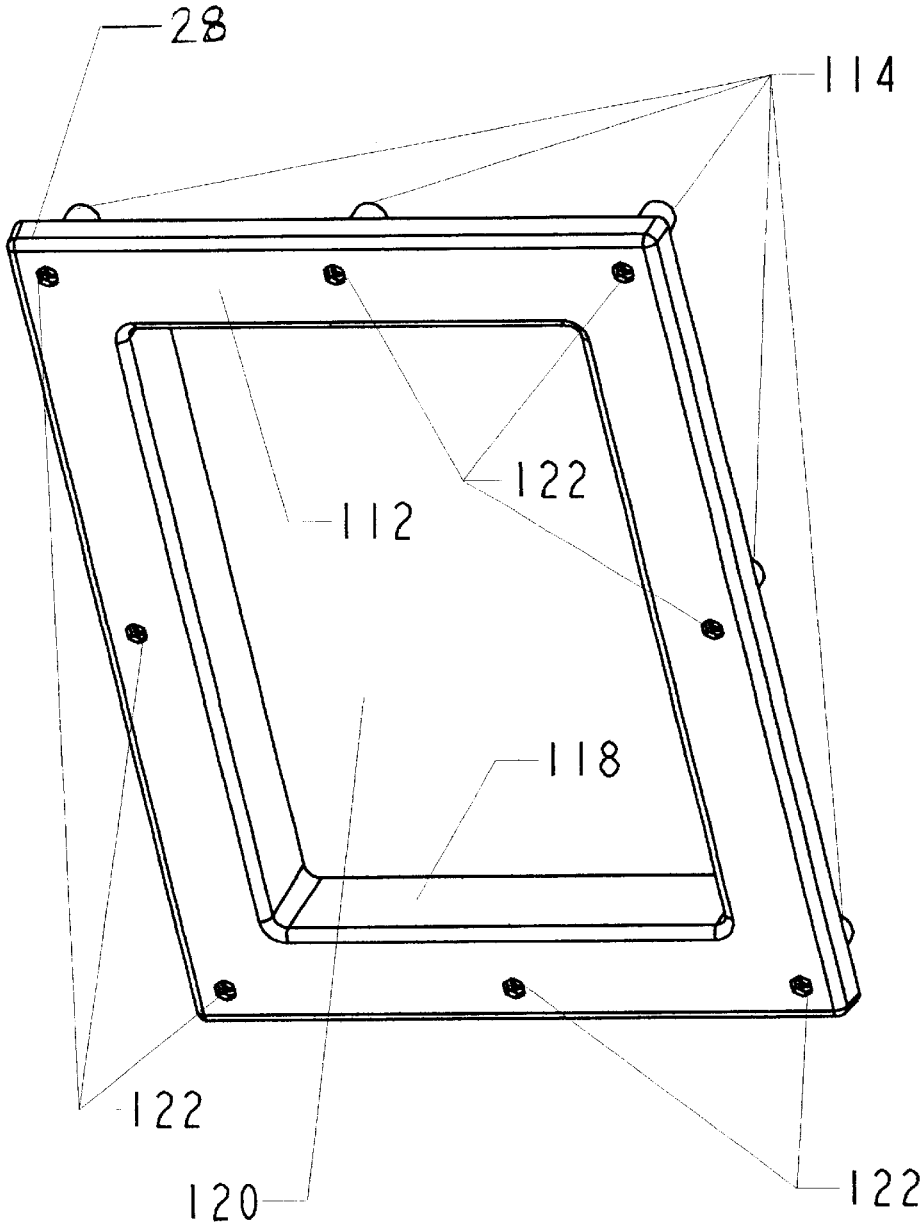
FIG. 13 shows a perspective view of the exterior side of the exterior frame.

FIG. 13 shows a perspective view of the exterior side of the exterior frame 28. In addition to features described for FIG. 12, this view shows hexagonal cavities at the exterior face terminus of the bosses 114. This allows the bolt 30 heads to be contained in and flush with the outer surface of the exterior frame 28, which will foil attempts to disassemble the invention from the outside of the domicile.

Figure 14:
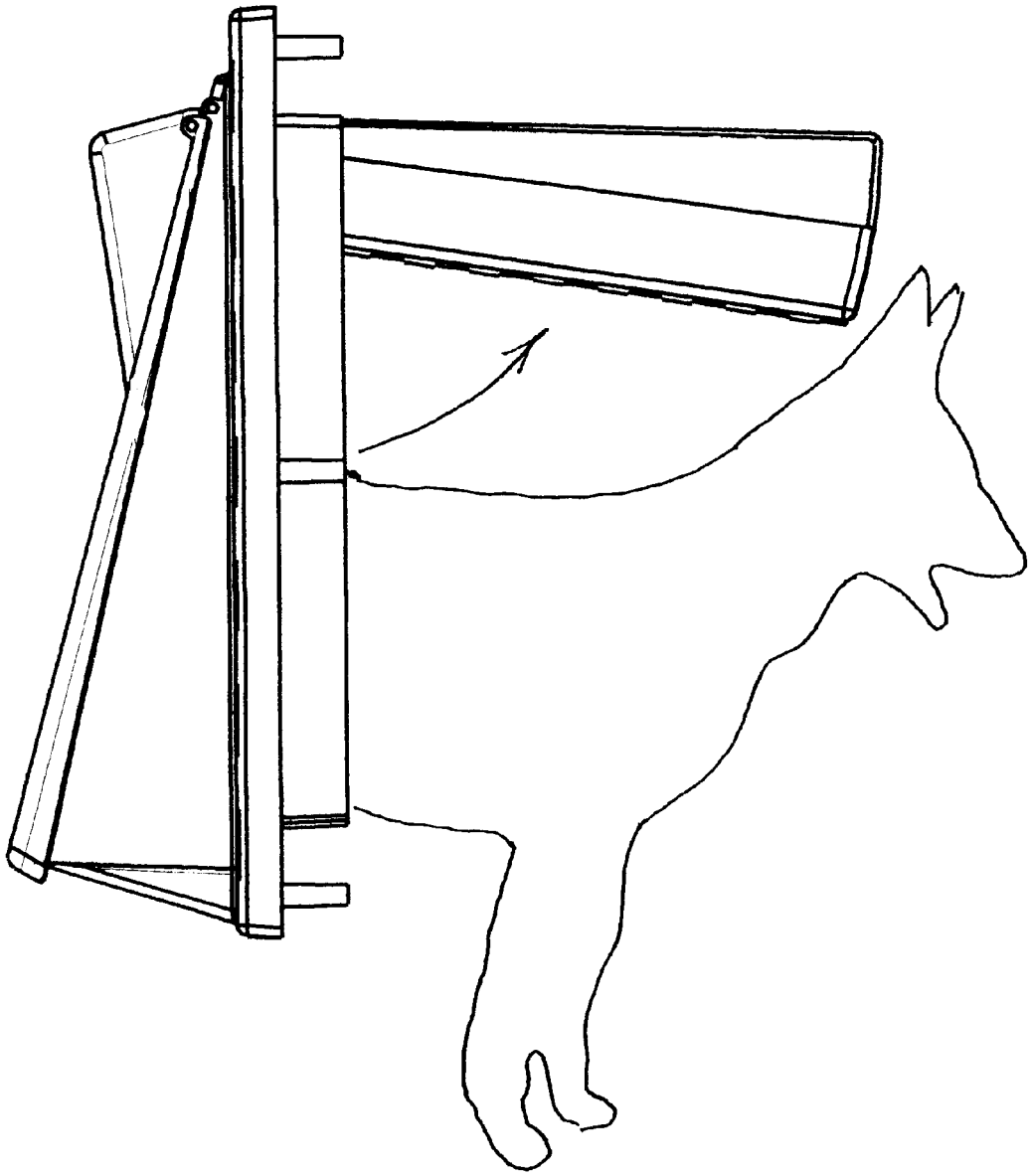
FIG. 14 shows a side view of the interior frame, outer door, and inner door position when an animal is exiting the enclosure.

FIG. 14 shows a side view of the interior frame, outer door, and inner door positions when an animal is exiting the enclosure. Only the outer door assembly pivots in this direction.

Figure 15:
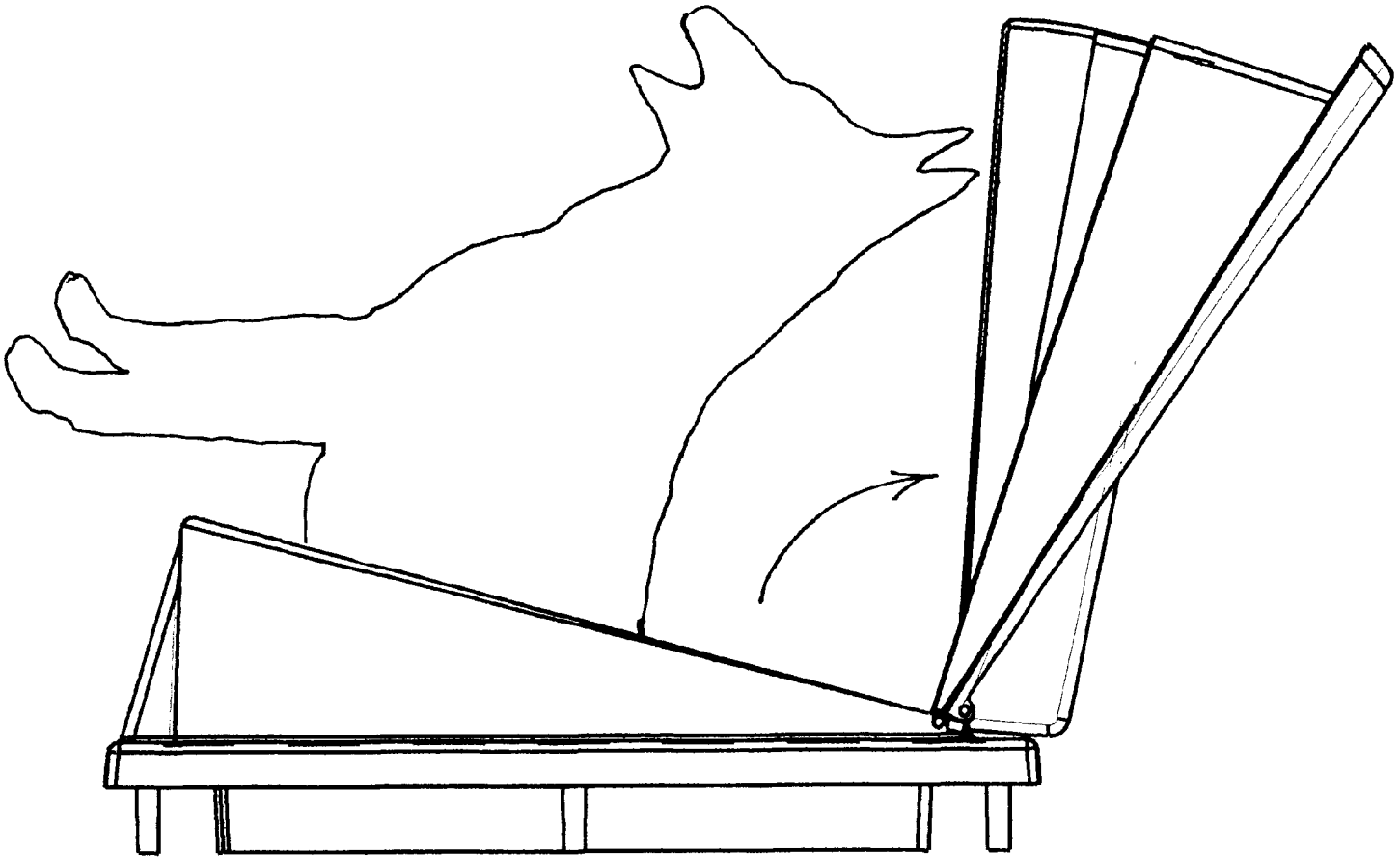
FIG. 15 shows a side view of the interior frame, outer door, and inner door position when an animal is entering the enclosure.

FIG. 15 shows a side view of the interior frame, outer door, and inner door positions when an animal is entering the enclosure. Both the outer and inner doors pivot in this direction.

OPERATION OF INVENTION—FIGS. 3, 14, and 15

The pet door installation is easily accomplished because of the design of the interior and exterior frames and optional wall spacer, as shown in FIG. 3. A single rectangular hole is cut in the residential door or wall that is just large enough to contain the bosses. Most residential door installations will not require the wall spacer, since the two frames will suffice to enclose the cutout surface. The frames and wall spacer (if needed) are assembled and bolted together. The pet door assembly self-adjusts for thickness of the wall or door during installation because the interior frame flange 58 fits inside either the wall spacer flange or the exterior frame flange, and the interior frame bosses 62 fit inside the wall spacer bosses 108 or the exterior frame bosses 114. The bolts are completely guided through the series of bosses, so they are easily installed.

The positioning of the two hinge points for the inner and outer doors is critical for the design, as is the shape of the doors and door stops. As FIG. 3 shows, the inner door 34 is hinged to the interior frame 22 by the inner door hinge pin 44, and is prevented from pivoting to a vertical position by the structure of the interior frame 22. The shape of the inner door 34 is designed to maintain its center of gravity to the left of the vertical plane containing the inner door pivot point, providing a torque acting to close the door when no counteracting force (provided by the domestic animal) is present. The outer door assembly 36 is hinged to the inner door 34 by the outer door hinge pin 46, and is prevented from pivoting to a vertical position by a lip 78 and inside walls 87 on the inner door 34. The shape of the outer door assembly 36 is designed to maintain its center of gravity to the right of the vertical plane containing the outer door pivot point, providing a torque acting to close the door when no counteracting force (provided by the domestic animal) is present. The weight of the outer door assembly 36 is applied at its pivot point to the left of the inner door pivot point, which provides additional closing torque to the inner door. The bottom portion of the outer door assembly (36) is shaped with enough clearance to allow the outer door to rotate freely and bidirectionally through the openings provided by the interior frame 22, wall spacer 26, and exterior frame 28. The inner door 34 is made of relatively thin walled plastic, and the outer door assembly 36 is comprised of a thin shell of plastic and an insulating foam core. Since the doors are relatively lightweight, they will be easily opened by a domestic animal that has been trained to use the pet door. Indeed, most animals will enjoy the complementary "back scratch" obtained by use of the door.

The outer door core 40 and the interior frame core 24 provide most of the insulating characteristics of the pet door. The resistance to heat transfer by significant thickness of insulating material is a well-known fact.

FIG. 3 also shows the operation of the locking bar 48 to prevent opening of the pet door. The bar is slid through a series of holes and channels that line up when the inner and outer doors are in closed position. When locking is not desired the bar can be removed and placed in the storage channel 68 (see FIG. 4) in the interior frame 22.

FIGS. 14 and 15 show the pet door in use. The animal pushes the outer door open to exit. The animal pushes both doors open to enter.

CONCLUSION, RAMIFICATIONS, AND SCOPE OF INVENTION

The reader will see that the pet door of this invention provides an easily installed, highly insulated, draft proof, weather resistant, animal friendly, and securable pet door that can be manufactured for relatively low cost.

While my above description contains many specificities, these should not be construed as limitations on the scope of the invention, but rather as an exemplification of one preferred embodiment thereof. Many other variations are possible. For example, the frames, doors, and openings could have different shapes, such as circular, oval, trapezoidal, triangular, etc.; magnets and ferrous metal components could be added to provide additional closing force for the doors; metal reinforcements could be added to the locking bar holes; outer door shells could be assembled by use of snap-fit connectors rather than screws; alternate materials—such as metal, wood, or fiberglass—could be used for the frames, doors, or wall spacer; alternate means of fabrication could be used to produce the components, such as welding, riveting, casting, snap-fit assembly, or gluing; and components could be connected to adjacent elements in a different manner than that described in the preferred embodiment.

Accordingly, the scope of the invention should be determined not by the embodiment illustrated, but by the appended claims and their legal equivalents.

I claim:

1. A pet door adapted to be placed over a cutout opening in a residence exterior door or wall, comprising:

a) a relatively rigid, substantially rectangular interior frame having a mounting surface lying substantially in a plane and adapted to be mounted flush against a room door or wall, circumjacent to a cutout opening therein;

b) said interior frame having a substantially rectangular opening through which an animal may pass;

c) said interior frame having an oblique angled projection forming a continuous inner door stop along the sides and bottom of interior frame said opening;

d) said interior frame having a plurality of inner door hinge knuckles along the top of said interior frame opening;

e) said interior frame having a flange surrounding the sides, top, and bottom of said interior frame opening;

f) a relatively rigid, substantially rectangular inner door having a plurality of inner door hinge knuckles along a top thereof;

g) said inner door having a substantially rectangular opening through which an animal may pass;

h) said inner door having a stop flange along the sides and bottom of said inner door opening for flush mating with an inner face of said inner door stop;

i) said inner door having a plurality of outer door hinge knuckles situated below and inside of said inner door hinge knuckles;

j) said inner door having an oblique angled continuous flange along the sides and bottom of said inner door opening forming an outer door stop;

k) a relatively rigid, substantially rectangular outer door having one or more outer door hinge knuckles along a top thereof;

l) interior face edges of said outer door being shaped to conform to an outer face of said outer door stop by flush mating;

m) said outer door having edges shaped for passage clearance of said continuous flange on said interior frame when pivoting outwards or inwards.

2. The pet door of claim 1 further comprising:

a) said interior frame constructed as a shell of relatively thin material, forming an interior frame cavity open to an exterior side thereof;

b) an interior frame core shaped to fit inside said interior frame cavity, composed of material resistant to heat transfer.

3. The pet door of claim 1 further comprising:

a) said outer door constructed as a shell of relatively thin material surrounding an outer door cavity;

b) an outer door core shaped to fit inside said outer door cavity, composed of relatively lightweight material resistant to heat transfer.

4. The pet door of claim 1 further comprising:

a) a plurality of holes aligned through said interior frame, said inner door, and said outer door to form a continuous channel when said inner and outer doors are in a closed position;

b) an elongated member shaped for insertion through said channel to prevent pivoting motion of said inner and outer doors, locking them shut.

5. The pet door of claim 1 further comprising:

a) a relatively rigid, substantially rectangular exterior frame having a mounting surface lying substantially in a plane and adapted to be mounted flush and on an opposite side of a room door or wall from said interior frame, circumjacent to an opening within;

b) said exterior frame having a continuous flange surrounding the sides, top, and bottom of said exterior frame opening, sized to fit relatively loosely around the flange of said interior frame so the overlap of the two flanges provides cutout hole surface encapsulation adjustable for thickness of the room door or wall in which said pet door is installed.

6. The pet door of claim 5 further comprising:

a) a wall spacer comprising a flange of the same height and width as for said exterior frame flange, to provide additional length of cutout hole surface encapsulation for thicker walls.

7. The pet door of claim 6 further comprising:

a) a plurality of hollow cylindrical bosses normal to a mounting plane of said exterior frame;

b) a matching plurality of hollow cylindrical bosses normal to a mounting plane of said wall spacer of equal diameter to said bosses of said exterior frame;

c) a matching plurality of hollow cylindrical bosses normal to a mounting plane of said interior frame, sized to allow insertion and sliding fit with said bosses of said wall spacer.

8. The pet door of claim 5 further comprising:

a) a plurality of hollow cylindrical bosses normal to a mounting plane of said exterior frame;

b) a matching plurality of hollow cylindrical bosses normal to a mounting plane of said interior frame, sized to allow insertion and sliding fit with said bosses of said exterior frame.

9. A pet door adapted to be placed over a cutout opening in a residence exterior door or wall, comprising:

a) a relatively rigid, substantially rectangular interior frame having a mounting surface lying substantially in a plane and adapted to be mounted flush against a room door or wall, circumjacent to a cutout opening therein;

b) said interior frame having a substantially rectangular opening through which an animal may pass;

c) said interior frame having a plurality of inner door hinge knuckles along the top of said interior frame opening;

d) said interior frame having a flange surrounding the sides, top, and bottom of said interior frame opening;

e) a relatively rigid, substantially rectangular inner door having a plurality of inner door hinge knuckles along a top thereof;

f) said inner door having a substantially rectangular opening through which an animal may pass;

g) said inner door having an oblique angled projection forming a continuous inner door stop along the sides and bottom of said inner door opening for flush mating with inner face of said interior frame h) said inner door having a plurality of outer door hinge knuckles situated below and inside of said inner door hinge knuckles;

i) said inner door having an oblique angled continuous flange along the sides and bottom of said inner door opening forming an outer door stop;

j) a relatively rigid, substantially rectangular outer door having one or more outer door hinge knuckles along a top thereof;

k) interior face edges of said outer door being shaped to conform to an outer face of said outer door stop by flush mating;

l) said outer door having edges shaped for passage clearance of said continuous flange on said interior frame when pivoting outwards or inwards.

10. The pet door of claim 9 further comprising:

a) said interior frame constructed as a shell of relatively thin material, forming an interior frame cavity open to an exterior side thereof;

b) an interior frame core shaped to fit inside said interior frame cavity, composed of material resistant to heat transfer.

11. The pet door of claim 9 further comprising:

a) said outer door constructed as a shell of relatively thin material surrounding an outer door cavity;

b) an outer door core shaped to fit inside said outer door cavity, composed of relatively lightweight material resistant to heat transfer.

12. The pet door of claim 9 further comprising:

a) a plurality of holes aligned through said interior frame, said inner door, and said outer door to form a continuous channel when said inner and outer, doors are in a closed position;

b) an elongated member shaped for insertion through said channel to prevent pivoting motion of said inner and outer doors, locking them shut.

13. The pet door of claim 9 further comprising:

a) a relatively rigid, substantially rectangular exterior frame having a mounting surface lying substantially in a plane and adapted to be mounted flush and on an opposite side of a room door or wall from said interior frame, circumjacent to an opening within;

b) said exterior frame having a continuous flange surrounding the sides, top, and bottom of said exterior frame opening, sized to fit relatively loosely around the flange of said interior frame so the overlap of the two flanges provides cutout hole surface encapsulation adjustable for thickness of the room door or wall in which said pet door is installed.

14. The pet door of claim 13 further comprising:

a) a wall spacer comprising a flange of the same height and width as for said exterior frame flange, to provide additional length of cutout hole surface encapsulation for thicker walls.

15. The pet door of claim 14 further comprising:

a) a plurality of hollow cylindrical bosses normal to a mounting plane of said exterior frame;

b) a matching plurality of hollow cylindrical bosses normal of mounting plane of said wall spacer of equal diameter to said bosses of said exterior frame;

c) a matching plurality of hollow cylindrical bosses normal to a mounting plane of said interior frame, sized to allow insertion and sliding fit with said bosses of said wall spacer.

16. The pet door of claim 13 further comprising:

a) a plurality of hollow cylindrical bosses normal to a mounting plane of said exterior frame;

b) a matching plurality of hollow cylindrical bosses normal to a mounting plane of said interior frame, sized to allow insertion and sliding fit with said bosses of said exterior frame.

* * * * *